US010989432B2

(12) United States Patent
Naito et al.

(10) Patent No.: US 10,989,432 B2
(45) Date of Patent: Apr. 27, 2021

(54) PREDICTIVE REFRIGERATION CYCLE

(71) Applicant: Hitachi-Johnson Controls Air Conditioning, Inc., Tokyo (JP)

(72) Inventors: Koji Naito, Tokyo (JP); Robert D. Turney, Watertown, WI (US); Liming Yang, Mequon, WI (US); Yasutaka Yoshida, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 81 days.

(21) Appl. No.: 16/370,051

(22) Filed: Mar. 29, 2019

(65) Prior Publication Data

US 2020/0309403 A1 Oct. 1, 2020

(51) Int. Cl.

| | |
|---|---|
| ***F24F 11/871*** | (2018.01) |
| ***F24F 11/47*** | (2018.01) |
| ***F24F 3/044*** | (2006.01) |
| ***F24F 11/64*** | (2018.01) |
| ***F24F 140/60*** | (2018.01) |
| ***F24F 110/10*** | (2018.01) |

(52) U.S. Cl.

CPC ..... *F24F 11/871* (2018.01); *F24F 3/044* (2013.01); *F24F 11/47* (2018.01); *F24F 11/64* (2018.01); *F24F 2110/10* (2018.01); *F24F 2140/60* (2018.01)

(58) Field of Classification Search

CPC ..... F24F 11/871; F24F 11/64; F24F 3/044; F24F 11/47; F24F 2110/10; F24F 2140/60

USPC ..... 62/181

See application file for complete search history.

(56) References Cited

U.S. PATENT DOCUMENTS

| | | | | |
|---|---|---|---|---|
| 4,196,628 | A * | 4/1980 | Schulze, Sr. | G01N 25/62 374/40 |
| 2011/0083454 | A1* | 4/2011 | Kopko | F25B 49/027 62/115 |
| 2012/0191253 | A1* | 7/2012 | Rockenfeller | F24F 11/30 700/276 |
| 2013/0314953 | A1* | 11/2013 | Cuzner | H02M 1/12 363/37 |
| 2014/0245764 | A1* | 9/2014 | Kibo | F25B 49/02 62/126 |
| 2016/0131378 | A1* | 5/2016 | Hinokuma | F24F 11/62 62/126 |

(Continued)

FOREIGN PATENT DOCUMENTS

| | | |
|---|---|---|
| JP | 05-118609 | 5/1993 |
| JP | 2006-162214 | 6/2006 |

(Continued)

*Primary Examiner* — Henry T Crenshaw

(74) *Attorney, Agent, or Firm* — Foley & Lardner LLP

(57) ABSTRACT

A refrigeration cycle, an air conditioning system, and a method for controlling a refrigeration cycle are provided. The refrigeration cycle includes an outdoor unit, an indoor unit, a controller, and an inverter. The controller controls a compressor and an outdoor fan of the air conditioning system so as to minimize a total electric power consumption of the air conditioning system. The inverter controls the outdoor fan in a rotation state predicted from a capacity demand in an air conditioning space depending on an operation mode and sensor values. The controller predicts the capacity demand and controls a rotation rate of the outdoor fan based on a prediction of the capacity demand.

14 Claims, 13 Drawing Sheets

(56) References Cited

U.S. PATENT DOCUMENTS

| | | | | |
|---|---|---|---|---|
| 2016/0377306 | A1* | 12/2016 | Drees | H02J 3/008 700/295 |
| 2017/0241690 | A1* | 8/2017 | Groshek | F04C 28/08 |
| 2018/0335233 | A1* | 11/2018 | Kremer | F04C 29/068 |

FOREIGN PATENT DOCUMENTS

| | | |
|---|---|---|
| JP | 2008-215678 | 9/2008 |
| JP | 2010-038487 | 2/2010 |
| JP | 2019-168151 | 10/2019 |
| WO | WO-2018/190334 | 10/2018 |

* cited by examiner

| Operation Step ($I_{Fan}$) | Fan Rotation (rev/sec) | Power Consp. ($W_{Fan}$) |
|---|---|---|
| 1 | V1 | $W_{Fan}1$ |
| 2 | V2 | $W_{Fan}2$ |
| 3 | V3 | $W_{Fan}3$ |
| 4 | V4 | $W_{Fan}4$ |
| ⋮ | ⋮ | ⋮ |

*FIG. 5A*

| Compressor Rotation (rev/sec) Operation Step ($I_{Comp}$) | Discharge Pressure.(Pd) | Suction Pressure.(Ps) | Suction Temp.(Ts) Discharge Temp.(Td) | Power Consp. ($W_{Comp}$) |
|---|---|---|---|---|
| C1 | Pd1 | Ps1 | Ts1 | $W_{Comp}1$ |
| C2 | | | | $W_{Comp}2$ |
| C3 | | | | $W_{Comp}3$ |
| C4 | | | | $W_{Comp}4$ |
| .<br>.<br>. | | | | .<br>.<br>. |

*FIG. 5B*

PREDICTIVE REFRIGERATION CYCLE

BACKGROUND

The present disclosure relates generally to a refrigeration cycle, and more particularly to a refrigeration cycle, an air conditioning system, and a method for controlling a refrigeration cycle.

A multiple packaged air conditioning unit system such as variable refrigerant flow (VRF) has been known for performing air conditioning of a building and the like. Such VRF system controls a plurality of indoor units by a shared outdoor unit and becomes popular and popular in an air conditioner of buildings. The VRF system may serve effectively air conditioning of buildings. However, there has been difficulty in optimal control of an outdoor fan and a compressor.

Inputs to an air conditioner may be dominated by a total value of a fan input and a compressor input and a trade-off relation is present where increasing an amount of airflow provided by an outdoor fan amounts reduces compressor inputs. Therefore, studies for obtaining an optimum control condition have been continued so far by increasing and decreasing a rotation rate of the outdoor fan.

For example, a prior art, Japanese Patent (Laid-Open) No. Heisei 05-118609 discloses the way in which rotation rates of the fan motor are increased and/or decreased so that a total value of electrical power consumption of the compressor and electrical power consumption of a fan motor for a condenser during cooling operation may become minimum.

SUMMARY

The prior art technique described above is effective under the condition that cooling capacity of the air conditioner is constant. However, the control is not disclosed clearly when the capacity of the air conditioning changes due to change in demands for the air conditioning. In the prior art technique, though the compressor input may be measured by current values, the capacity is not measured and the change in the capacity cannot be detected. In addition, even if generated capacity is known, the prior art technique cannot find optimum points upon changing the capacity.

Considering the above problem in the prior art technique, an object of the present invention is to provide a refrigeration cycle, an air conditioning system, and a method for controlling a refrigeration cycle.

One implementation of the present disclosure is a refrigeration cycle for an air conditioning system including an outdoor unit and an indoor unit. The refrigeration cycle includes a controller and an inverter. The controller controls a compressor and an outdoor fan of the air conditioning system so as to minimize a total electric power consumption of the air conditioning system. The inverter controls the outdoor fan in a rotation state predicted from a capacity demand in an air conditioning space depending on an operation mode and sensor values. The controller predicts the capacity demand and controls a rotation rate of the outdoor fan based on a prediction of the capacity demand.

In some embodiments, the controller predicts the capacity demand using an air enthalpy method in a heating mode or using a compressor curve method in a cooling mode when the capacity demand is predicted to change.

In some embodiments, the controller determines the rotation state of the outdoor fan so as to minimize the total electric power consumption of the compressor and the outdoor fan when the capacity demand is predicted to remain substantially constant.

In some embodiments, the controller predicts the capacity demand using historical changes in electrical power consumption of the compressor and a historical capacity demand.

In some embodiments, the rotation state of the outdoor fan is determined using a ratio comprising historical values of the capacity demand predicted and the electric power consumption.

Another implementation of the present disclosure is an air conditioning system including an outdoor unit and an indoor unit. The air conditioning system includes a controller and an inverter. The controller controls a compressor and an outdoor fan of the air conditioning system so as to minimize a total electric power consumption of the air conditioning system. The inverter controls the outdoor fan in a rotation state predicted from a capacity demand in an air conditioning space depending on an operation mode and sensor values. The controller predicts the capacity demand and controls a rotation rate of the outdoor fan based on a prediction of the capacity demand.

In some embodiments, the controller predicts the capacity demand using an air enthalpy method in a heating mode or using a compressor curve method in a cooling mode when the capacity demand is predicted to change.

In some embodiments, the controller determines the rotation state of the outdoor fan so as to minimize the total electric power consumption of the compressor and the outdoor fan when the capacity demand is predicted to remain substantially constant.

In some embodiments, the controller predicts the capacity demand using historical changes in electrical power consumption of the compressor and a historical capacity demand.

In some embodiments, wherein the rotation state of the outdoor fan is determined using a ratio comprising historical values of the capacity demand predicted and the electric power consumption.

In some embodiments, the air conditioning system includes a plurality of indoor units controlled by a shared outdoor unit.

Another implementation of the present disclosure is a method for controlling a refrigeration cycle including an outdoor unit and an indoor unit. The method includes controlling a compressor and an outdoor fan of so as to minimize a total electric power consumption of an air conditioning system, controlling the outdoor fan in a rotation state predicted from a capacity demand in an air conditioning space depending on an operation mode and sensor values; and predicting the capacity demand and controlling a rotation rate of the outdoor fan based on a prediction of the capacity demand.

In some embodiments, the capacity demand is predicted using an air enthalpy method in a heating mode or using a compressor curve method in a cooling mode when the capacity demand is predicted to change.

In some embodiments, the rotation state of the outdoor fan is determined so as to minimize the total electric power consumption of the compressor and the outdoor fan when the capacity demand is predicted to remain substantially constant.

In some embodiments, the capacity demand is predicted using historical changes in electrical power consumption of the compressor and a historical capacity demand.

In some embodiments, the rotation state of the outdoor fan is determined using a ratio comprising historical values of the capacity demand predicted and the electric power consumption.

In some embodiments, the air conditioning system includes a plurality of indoor units controlled by a shared outdoor unit.

Another implementation of the present disclosure is one or more non-transitory computer-readable media storing instructions. When executed by one or more processors, the instructions cause the one or more processors to perform operations including controlling a compressor and an outdoor fan of so as to minimize a total electric power consumption of an air conditioning system, controlling the outdoor fan in a rotation state predicted from a capacity demand in an air conditioning space depending on an operation mode and sensor values, and predicting the capacity demand and controlling a rotation rate of the outdoor fan based on a prediction of the capacity demand.

In some embodiments, the capacity demand is predicted using an air enthalpy method in a heating mode or using a compressor curve method in a cooling mode when the capacity demand is predicted to change.

In some embodiments, the rotation state of the outdoor fan is determined so as to minimize the total electric power consumption of the compressor and the outdoor fan when the capacity demand is predicted to remain substantially constant.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

FIG. 5A shows a data structure preferably stored as a look-up table in the ROM of FIG. 3 used for controlling the fan motor of the outdoor unit of FIG. 2 with the inverter of the outdoor unit of FIG. 2, according to some embodiments.

FIG. 5B shows a data structure preferably stored also as a look-up table in the ROM of FIG. 3 used for controlling the compressor of the outdoor unit of FIG. 2 with the inverter of the outdoor unit of FIG. 2, according to some embodiments.

DETAILED DESCRIPTION

Overview

Referring generally to the FIGURES, a refrigeration cycle, an air conditioning system, and a method for controlling a refrigeration cycle, which reduce the electrical power consumption under the operation in a partial load as well as annual electrical power consumption are shown, according to various exemplary embodiments.

Specific embodiments of the present disclosure will now be described with referring to the accompanying drawings. The systems and methods described herein may, however, be embodied in many different forms and should not be construed as limited to the embodiments set forth herein. Rather, these embodiments are provided so that this disclosure will be thorough and complete, and will fully convey the scope of the invention to those skilled in the art. The terminology used in the detailed description of the embodiments illustrated in the accompanying drawings is not intended to limit the invention.

Air Conditioning System and Refrigeration Cycle

Figure 1:
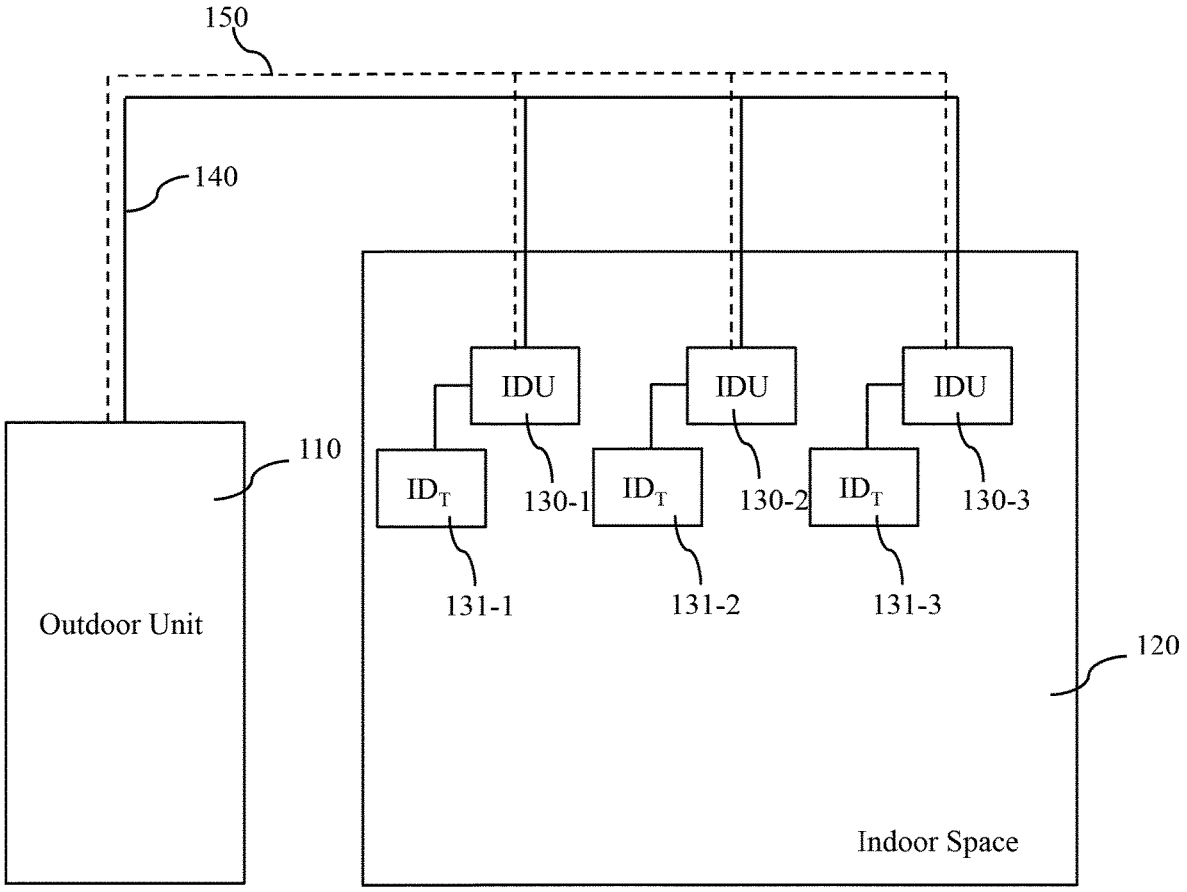
FIG. 1 is a block diagram of an air conditioning system including an outdoor unit and a plurality of indoor units, according to some embodiments.

FIG. 1 shows an air conditioning system and refrigeration cycle as one embodiment comprising a refrigerant. The exemplary air conditioning system may be embodied as an air conditioning apparatus and more preferably may be embodied as a VRF system, a PAC system, a RAC system, and a chiller system and the like. In this description, as for convenience in description, it is assumed that the refrigeration cycle is implemented in an air conditioning system constructed as a VRF (variable refrigerant flow) system including an outdoor unit 110 and a plurality of indoor units (IDUs) 130-1, 130-2, and 130-3. A plurality of the IDUs 130-1, 130-2, and 130-3 are controlled cooperatively by the shared outdoor unit 110. The outdoor unit 110 is placed at an outdoor space and the IDUs 130-1, . . . , 130-3 are placed in an indoor space 120 such as an office building and an apartment house and the like.

The outdoor unit 110 controls a plurality of the indoor units 130-1, 130-2, and 130-3 for serving air conditioning in the building space and also for addressing air conditioning demands. The IDU performs air conditioning of the room in response to demands for the air conditioning. Although three indoor units 130-1, . . . , 130-3 are illustrated in FIG. 1, the number of indoor units may be selected depending particular demands for air conditioning in the building. In addition, the IDUs 130-1, . . . , 130-3 may be placed in one large room altogether, or alternatively, each IDU may be placed in an individual room, but not limited thereto, combinations of the number of IDUs and room arrangements are not limited to the illustrated embodiment and may be changed depending on particular demands for air conditioning.

To the IDUs 130-1, . . . , 130-3, temperature sensors IDT 131-1, . . . , 131-3 each including a $T_i$, sensor and a $T_o$ sensor are disposed to detect an input temperature $T_i$, value to each of the IDUs 130-1, . . . , 130-3 and also to detect an output temperature $T_o$ value from each of the IDUs 130-1, . . . , 130-3. These temperature values are transmitted to the outdoor unit 110 through a transmission line 150 and may be used for determining air conditioning demands in the indoor space 120, but not limited thereto, other sensors to detect change in air conditioning loads may be separately disposed to the IDUs 130-1, . . . , 130-3 depending on particular applications.

The outdoor unit 110 and the IDUs 130-1, . . . , 130-3 are fluid connected with each other and also with the outdoor unit 110 by piping 140 for circulating the refrigerant. In turn, the outdoor unit 110 and the IDUs 130-1, . . . , 130-3 are connected with the communication line 150 for controlling air conditioning performance of a plurality of the IDUs 130-1, . . . , 130-3 so as to provide adequate air conditioning in the building according to an embodiment.

Figure 2:
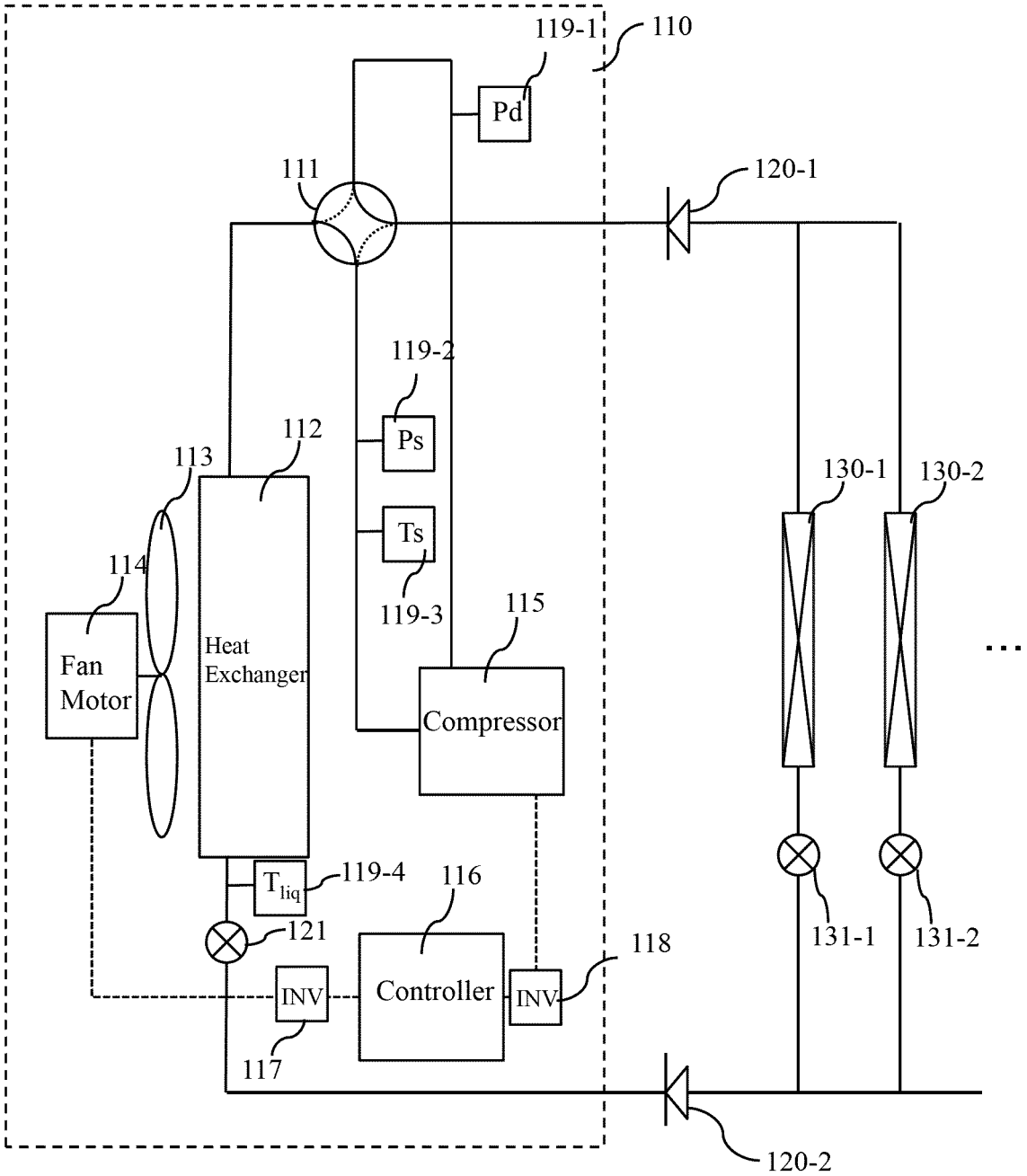
FIG. 2 is a block diagram illustrating a hardware arrangement of an air conditioning system of FIG. 1 in greater detail, according to some embodiments.

FIG. 2 shows a hardware arrangement of an air conditioning system of one embodiment and the outdoor unit 110 comprises a compressor 115, a heat exchanger 112, and an outdoor fan 113 driven by a fan motor 114. The compressor 115 may be formed as a scroll type compressor and compress the refrigerant for air conditioning purpose. The heat exchanger unit 112 performs heat exchange of the refrigerant flowing through a four-way valve 111 to and from the IDUs 130-1, 130-2 and so on. Fluid paths of the four-way valve 111 are indicated by solid lines and dotted lines; the solid line indicates the fluid path for a cooling mode and the dotted line indicates the fluid path for a heating mode, respectively.

The outdoor fan 113 causes the flow of outdoor air against the heat exchanger 112 for controlling temperature of the heat exchanger 112 for improving efficiency of air conditioning. The outdoor unit 110 further comprises a controller 116 for controlling operation of the compressor 115 and the fan 112 through inverters 117, 118 so as to achieve adequate air conditioning.

The outdoor unit 110 further comprises various sensors such as Pd 119-1, Ps 119-2, Ts 119-3, and $T_{liq}$ 119-4. These sensors are used to predict near-future capacity for air conditioning from parameters of the refrigerant circulating in the air conditioning system. The functions of the sensors will be described now. The sensor Pd 119-1 detects discharge pressure of the refrigerant; the sensor Ps 119-2 detects suction pressure of the compressor 115. The sensor Ts 119-3 detects suction temperature. The sensor $T_{liq}$ 119-4 detects temperature of the refrigerant at the position adjacent to the heat exchanger 112.

The outdoor unit 110 is connected with the IDUs through piping and adequate valves 120-1, 120-2, 131-1, and 131-2 such as an expansion valve and the like such that the refrigerant conditioned in the outdoor unit 110 is circulated to each of the IDUs 130-1 and 130-2 for serving demanded air conditioning. In one embodiment, the controller 116 controls operation of the compressor 115 and the outdoor fan 113 through the inverters 117, 118 depending on a predicted air conditioning capacity.

Figure 3:
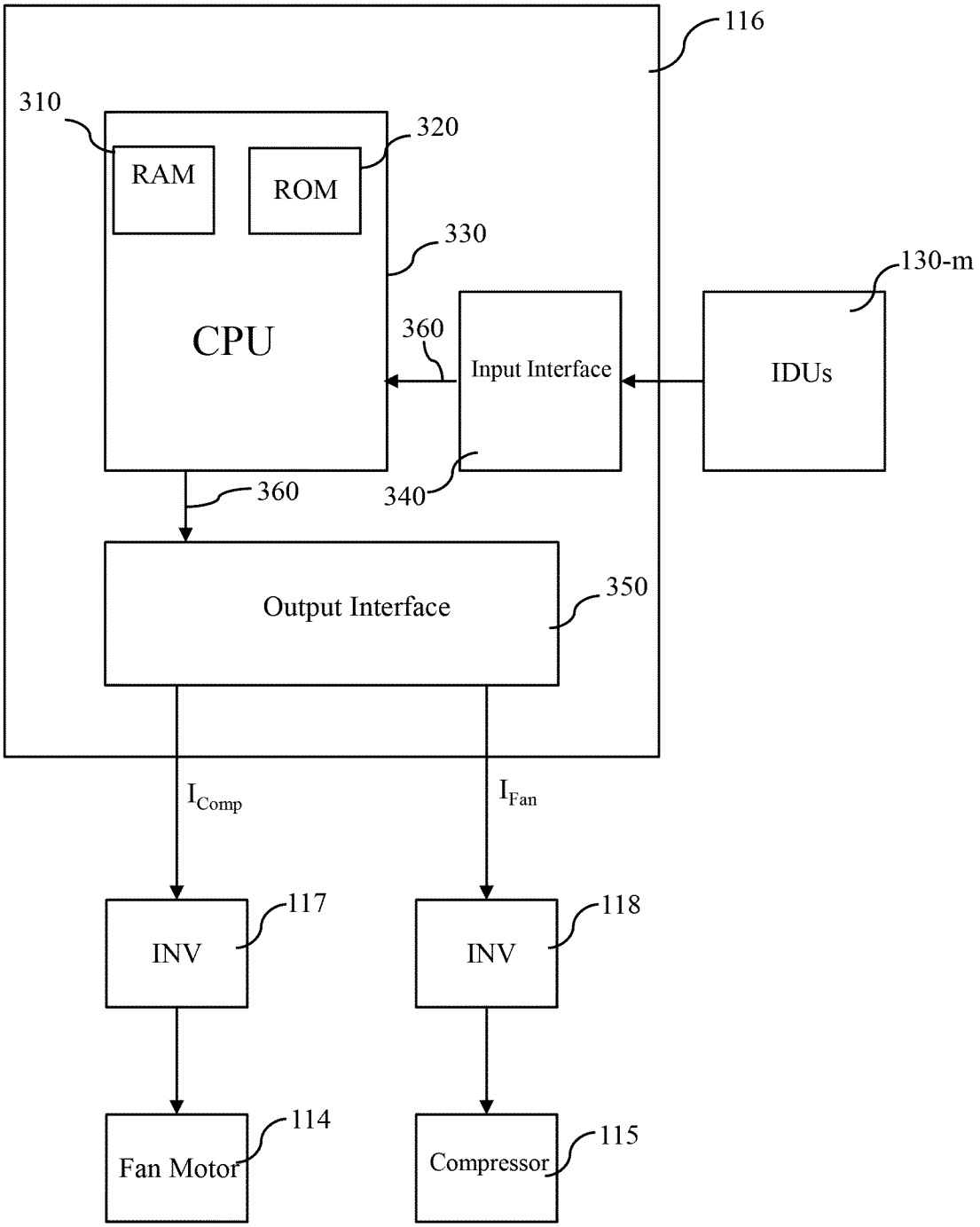
FIG. 3 is a block diagram illustrating a hardware architecture of the controller of FIG. 2 in greater detail, according to some embodiments.

FIG. 3 shows a hardware architecture of the controller 116. In one embodiment, the controller is implemented as a controller board on which various electronics are implemented and the controller board may be disposed inside of the outdoor unit 110. In FIG. 3, for an illustrative purpose, external devices such as the inverters 117, 118, the fan motor 114 and the compressor 115 as well as the IDUs **130-*m*** (here m is a natural number) are depicted.

The controller 116 comprises a RAM 310, a ROM 320, and a CPU 330. The RAM 310 is a temporal memory for storing various data and provides a working space of the CPU 330. The RAM 310 may be implemented as a semiconductor module of the CPU 330 as depicted in FIG. 3, in this instance register memories implemented in the CPU 330 may be used in place of and/or together with the RAM 310. The ROM 320 is a non-volatile memory implemented as a semiconductor module of the CPU 330 and stores various programs and data for performing air conditioning processing. As described herein, the RAM 310 and the ROM 320 may be implemented inside modules of the CPU 330, however, the RAM 310 and the ROM 320 may be disposed separately from the CPU 330 in another embodiment. The CPU 330 may be implemented as a microprocessor, and into the CPU 330, data from the IDUs 130-1, . . . , **130-*m* are input through the communication line 150 through an input interface 340 and also an I/O bus 360** for executing control of the air conditioning system.

The data sent from the IDUs 130-1, . . . , **130-*m* may be input temperature and output temperature of each IDU. However, other data may be sent from the IDUs 130-1, . . . , 130-*m* depending on particular applications. The CPU 330 applies various processing steps to the input data and outputs results of the processing steps to the inverters 117, 118 through an output interface 350 for making the fan motor 114 and the compressor 115 to move according to the instructions or inputs illustrated as $I_{Comp}$ and $I_{Fan}$ issued from the CPU 330**.

Figure 4:
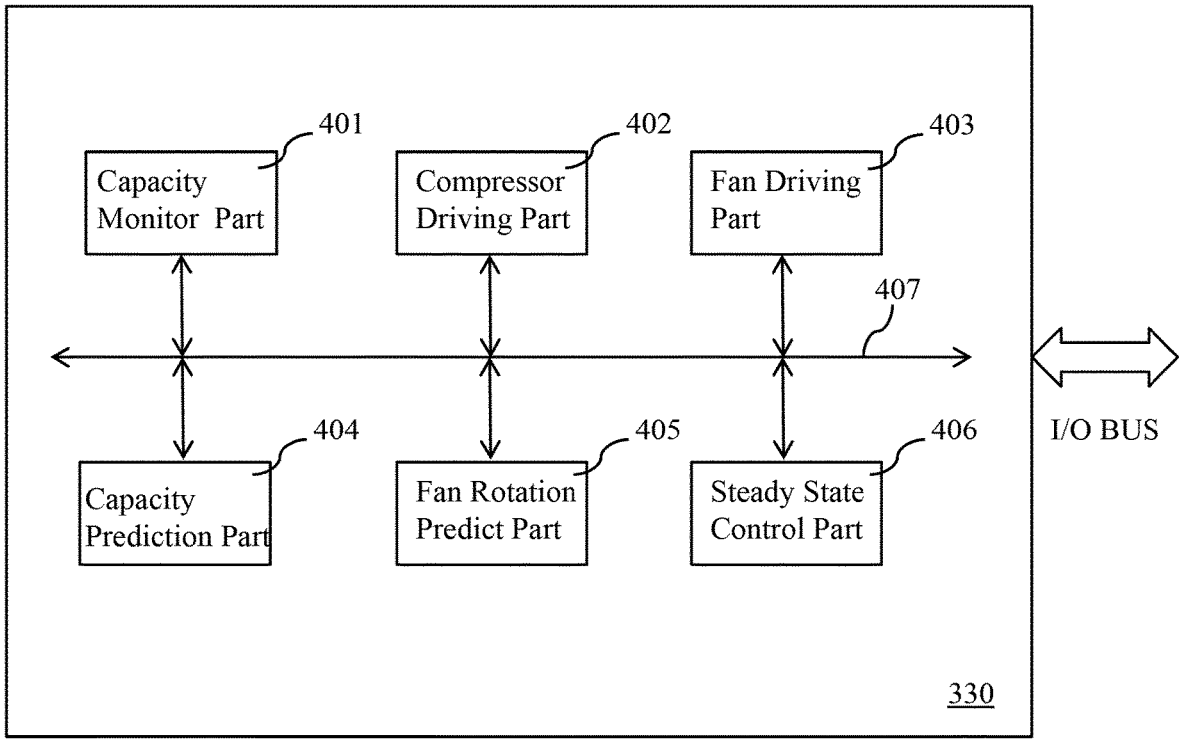
FIG. 4 is a block diagram illustrating a functional architecture of the CPU of FIG. 3 in greater detail, according to some embodiments.

The CPU 330 executes various programs to perform the control and FIG. 4 depicts a functional architecture of the CPU 330. The CPU 330 provides various functional parts and functions depicted as a capacity monitor part 401, a compressor driving part 402, and a fan driving part 403. The capacity monitor part 401 monitors an operation status of the IDUs 130-1, . . . , **130-*m* from the temperature signals sent from the IDUs 130-1, . . . , 130-*m*. The temperature signals include an input temperature value and an output temperature value of each IDU and are sent from each of the IDUs 130-1, . . . , 130-*m* in a predetermined sampling interval for predicting capacity change in near future. The term "near future" means herein the time-lag in which the demands for air conditioning will be provided as feedback to mechanical devices such as at least compressor 115** and the like.

The compressor driving part 402 controls the compressor 115 by outputting the $I_{Comp}$ such as a driving step instruction to the inverter 118 for driving the compressor 115. The fan driving part 403 controls the fan motor 114 as well as the fan 113 to control rotation rates of the fan motor 114 by selecting and then outputting $I_{Fan}$ such as a driving step instruction to the inverter 117 for driving the fan motor 114.

The CPU 330 further functions as a capacity prediction part 404, a fan rotation prediction part 405 and a steady state control part 406. The capacity prediction part 404 predicts the capacity demands from the data of the sensors 119-1-119-4 and temperature sensors disposed to each of IDUs 130-1, . . . , **130-*m*. The fan rotation prediction part 405 predicts the fan rotation rate depending on the prediction for the capacity demands by the prediction part 404 for attaining predictive control of the air conditioning system for electrical power saving. The steady state control part 406 controls the air conditioning system during the steady state operation thereof so as to further optimize the electrical power consumption of the air conditioning system by seeking an optimum rotation state of the fan motor 114** under the condition that the demands for air conditioning is relatively stable.

The functional parts depicted in FIG. 4 are interconnected by a system bus line 407 such that these functional parts may communicate each other to make the CPU 330 perform the air conditioning control in one embodiment. Processing results of the CPU 330 are output through an I/O bus 360 to external devices for controlling the external devices in response to the instructions from the CPU 330. In another embodiment, the register memory may be implemented in the CPU 330 rather than providing the independent RAM 310. In further another embodiment, the CPU 330 may be implemented as an ASIC (Application Specific Integrated Circuit) with implementing the functions of inverters 117, 118 as well as other functions.

Lookup Tables

FIG. 5A shows a data structure preferably stored as a look-up table in the ROM 320 used for controlling the fan motor 114 with the inverter 117. However, the embodiment shown in FIG. 5A is mere example and the data structure of FIG. 5A may have any format and implementations so far as the data can be used by the CPU 330. The inverter 117 as well as the inverter 118 may be formed as microcomputers or semiconductor devices that can control rotational states or steps through instructions sent by the CPU 330.

One embodiment shown in FIG. 5A corresponds to the data structure for controlling the rotational state of the fan motor 114 that controls air flow amounts of the outdoor fan 113 against the heat exchanger 112. In one embodiment, the fan motor 114 may be controlled in multiple levels as shown in FIG. 5A, and when the operation step increases by one step, the fan rotation rate in a rev/sec unit increases by a corresponding predetermined amount. In one particular embodiment, the power consumption of the fan motor 114 may be predicted by operation step values listed in FIG. 5A. In one particular embodiment, electrical power consumption values $W_{Fan}$ in a watt unit may be stored in association with the operation step to calculate the electrical power consumption of the fan motor 114. Further in another embodiment, power consumption of the fan motor 114 may be practically measured to compute the total value of electrical power consumption by an adequate sensor.

FIG. 5B shows a data structure preferably stored also as a look-up table in the ROM 320 used for controlling the compressor 115 by the inverter 118. The inverter 118 may also be formed as microcomputers or semiconductor devices that can control rotational states or steps through instructions generated by the CPU 330. In a particular embodiment, since sensors for detecting discharge pressure (Pd), suction pressure (Ps), suction temperature (Ts) or discharge temperature (Td) of the refrigerant are disposed to the system, such parameters can readily be incorporated in the look-up table so as to predict electrical power consumption more precisely.

One embodiment shown in FIG. 5B corresponds to the data structure for controlling the rotational state of the compressor 115 that controls the electric power consumption of the compressor 115. In one embodiment, the compressor 115 may be controlled in multiple levels as shown in FIG. 5B likely to the fan motor 114. Similar to the fan motor 114, when the operation step increases by one step, the rotational rate of the compressor 115 increases by a corresponding predetermined rate. In one particular embodiment, the power consumption of the compressor 115 may be calculated by operation step values listed in FIG. 5B. In another particular embodiment, the electrical power consumption values $W_{Comp}$ in a watt unit may be stored in association with the operation step to estimate or predict the power consumption of the fan motor 114. Further in another embodiment, power consumption of the compressor 115 may be practically measured to compute the total electrical power consumption.

In the embodiment that the electrical power consumption values of the compressor 115 and the fan motor 114 are each stored as the control data as shown in FIG. 5A and FIG. 5B, the CPU 330 can calculate and predict the total amount of electrical power consumption of the compressor 115 and the fan motor 114 with looking-up the data structures such that the CPU 330 may predict the total electrical power consumption of the compressor 115 and the fan motor 114 without other sensors for detecting the electrical power consumption of the compressor 115 and the fan motor 114. In other embodiment, depending on particular requirements, the CPU 330 may obtain actual values of the electrical power consumption of the compressor 115 and the fan motor 114. These detected values can be provided as feedback to the control processes described herein.

Graphs and Control Processes

Figure 6A:
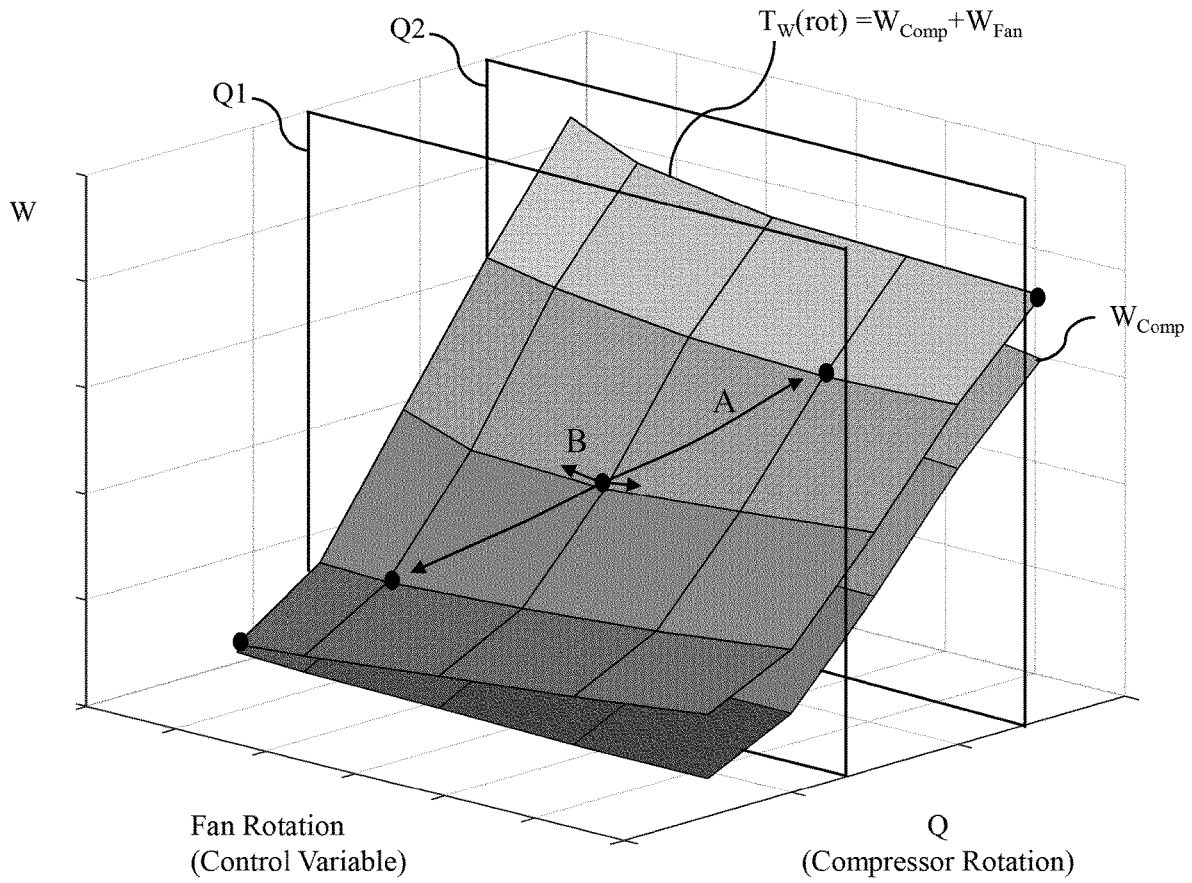
FIG. 6A is a graph illustrating the electrical power consumption of the air conditioning system of FIG. 1 as a function of fan rotation and compressor rotation, according to some embodiments.
Figure 6B:
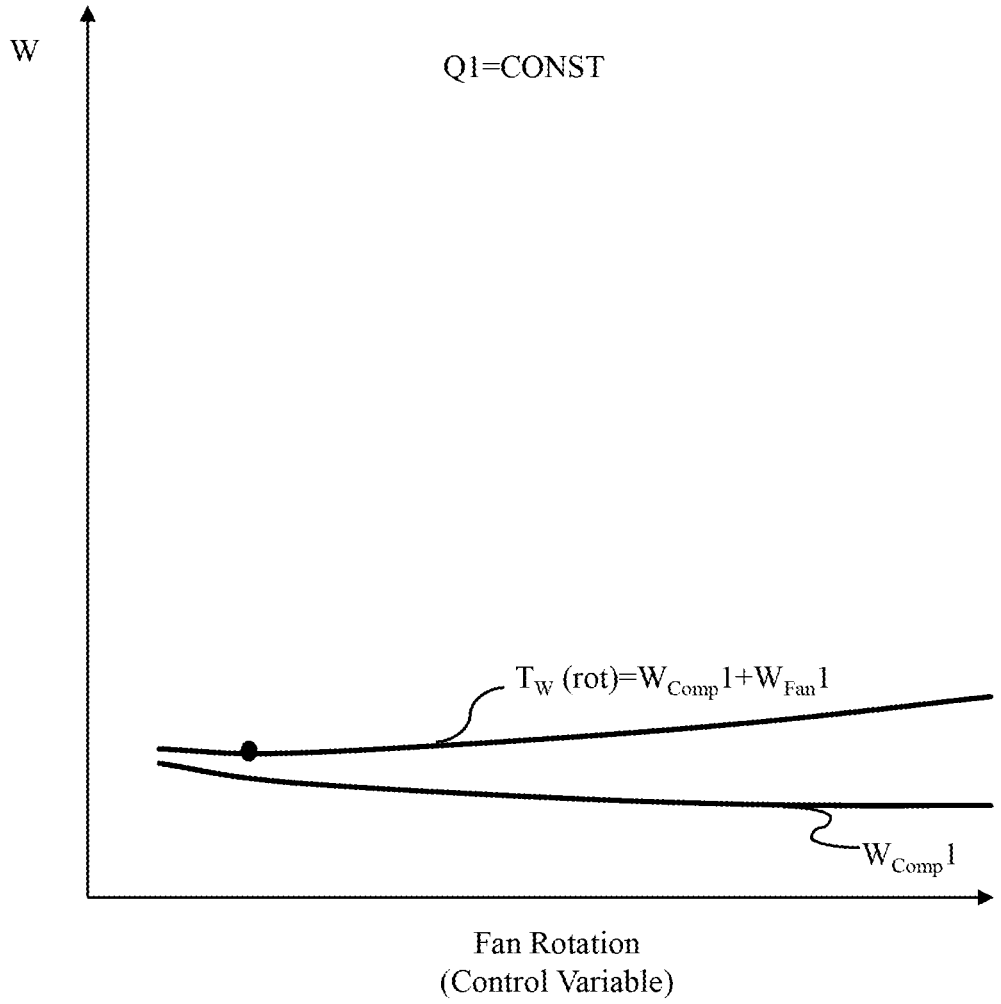
FIG. 6B is a graph illustrating an electrical power consumption property in two-dimension on the iso-capacity plane Q1 of FIG. 6A, according to some embodiments.
Figure 6C:
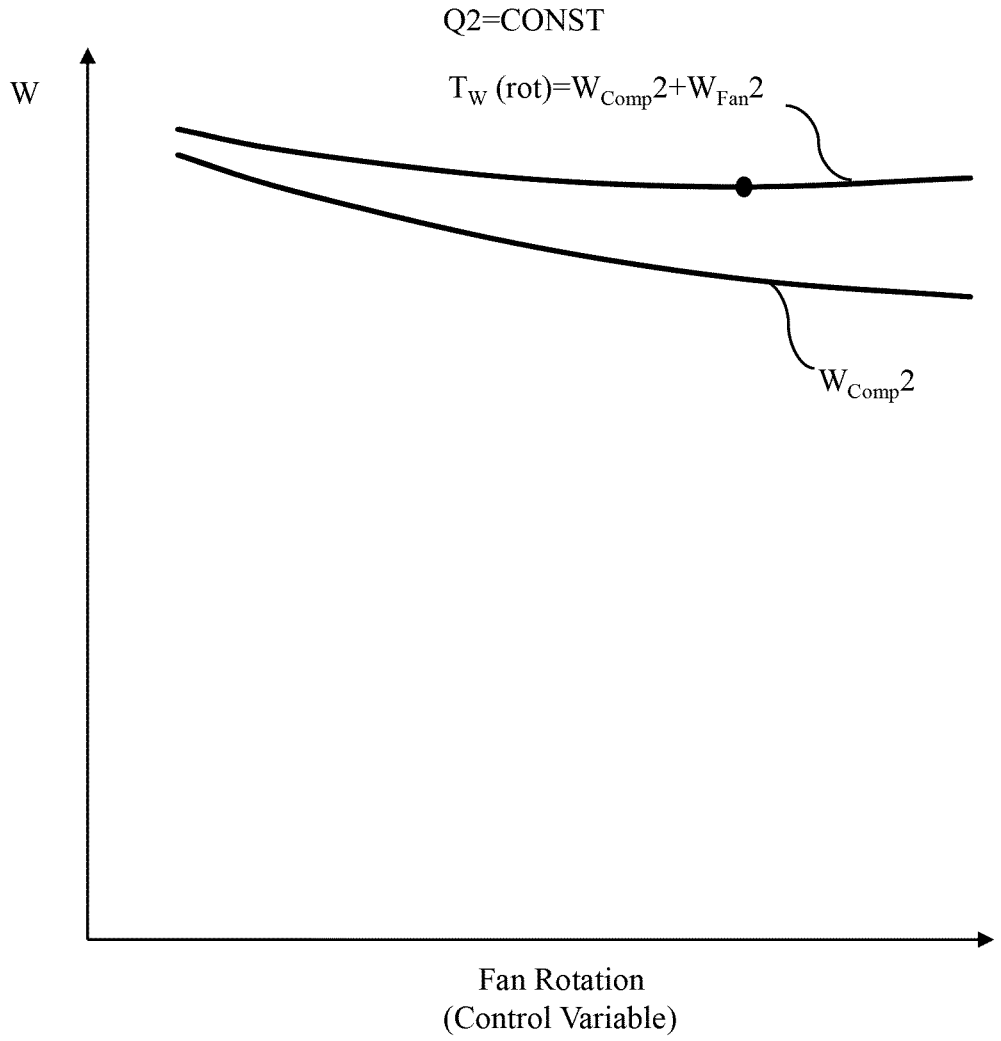
FIG. 6C is a graph illustrating an electrical power consumption property in two-dimension on the iso-capacity plane Q2 of FIG. 6A, according to some embodiments.

Referring now to FIGS. 6A-6C, several graphs illustrating a control process of one embodiment will be described. However, the present invention may be implemented in different forms, devices and/or constructions so far as advantages of embodiments can be achieved and is not limited to the embodiment described hereafter. FIG. 6A depicts a graph of the electrical power consumption of the air conditioning system. In FIG. 6A, a vertical axis represents the electrical power consumption in watt (W) and extends vertically to a plane defined by a Q (capacity) axis and a rotation axis of the compressor 115 and/or the outdoor fan motor 114. Hereafter, as for convenience in description, the rotation axis of the compressor 115 and/or the outdoor fan motor 114 is simply referred as a "control variable" axis. This means that the rotation rate is chosen as the controlled variable to optimize the total value of electrical power consumption.

In FIG. 6A, lower curved lines show compressor properties at a given operation step and an upper curved plane shows the total value of the electrical power consumption of the compressor 115 and the outdoor fan 114. The horizontal axis is represented in a watt unit (W) for convenience in descriptions, however, the horizontal axis may be replaced with a summation of control values such as the operation steps for the compressor 115 $I_{Comp}$ and the fan motor 114 $I_{Fan}$.

As described earlier with referring to FIG. 5A and FIG. 5B, one embodiment may predict the electrical power consumption of the compressor 115 and the outdoor fan 114 from their operating steps. The total value of the electrical power consumption of the compressor 115 and the outdoor fan 114 may be calculated by a function $Tw(rot)=W_{Comp}+W_{Fan}$. It should be noted that the function is not limited to one in the watt unit and other parameters such as $I_{comp}$ and $I_{Fan}$ without physical dimensions for indicating the power consumption states may be used to represent the total electrical power consumption together with a constant having an adequate dimension provided as $Tw(rot)=Constant_1*I_{Comp}+Constant_2*I_{Fan}$(Constant_1 and Constant_2 are constants with adequate physical dimensions). Under this definition and according to the present embodiment, the rotation state of the outdoor fan 114 is controlled actively to optimize the electrical power consumption as the control variable. So, the function Tw(rot) is regarded as a target function to be minimized by controlling rotation rates of the compressor 115 and/or the outdoor fan 114, i.e., the fan motor 113.

With referring to FIG. 6A, on the same capacity Q1, when the fan rotation decreases, the electrical power consumption of the compressor increases. In the cooling mode, the outdoor heat exchanger functions as a condenser. As the fan rotation decreases, condenser performance goes down. So, the discharge pressure increases and the pressure difference between Pd and Ps becomes large and hence, a compressor load and the electrical power consumption increase. In the heating mode, the outdoor heat exchanger now functions as an evaporator. As the fan rotation decreases, an evaporator performance goes down. So, the suction pressure decreases and the pressure difference between Pd and Ps becomes large and hence, the compressor load and the electrical power consumption increase. It is noted that the minimum points will vary with respect to the operation conditions of the compressor 115 and the fan motor 114. The generated total value of the electrical power consumption Tw (rot) exhibits a concave plane with respect to the control variable. As convenience for understanding the embodiment, two iso-capacity planes Q1 and Q2 are depicted as imaginary planes parallel to the sheet of FIG. 6A.

An arrow "A" indicates a schematic predictive control strategy according to one embodiment executed when the capacity change is expected to be relatively large. An arrow "B" indicates a schematic steady state control strategy executed when the capacity change is not relatively large.

According to one embodiment, when air conditioning loads change, there is a correlation between capacity increase and increase in compressor input and/or between capacity decrease and decrease in the compressor input. In this correlation, time-lag occurs in a property in a capacity controlling side. Therefore, in one embodiment, the operation control is performed such that the fan rotation is decreased in response to increase in the compressor input, and alternatively, the fan rotation is decreased in response to increase in the compressor input. Furthermore, in one embodiment, the rotation rate of the outdoor fan 113 may be set for balancing the change in the demands and the compressor input, because the control of the outdoor fan 113 can be relatively straightforward while the control of a refrigeration cycle has the time-lag.

These two-control strategies will be detailed later using FIG. 6B and FIG. 6C with cutting-off three-dimensional space shown in FIG. 6A. The filled circles in FIG. 6B and FIG. 6C correspond to the filled circles on the iso-capacity planes Q1 and Q2, respectively. FIG. 6B shows an electrical power consumption property shown in the two-dimension profile on the iso-capacity plane Q1 of FIG. 6A. As described earlier, the electrical power consumption of the compressor $W_{Comp}$1 increases as the fan rotation decreases. Thus, the total electrical power consumption given by the function Tw(rot) exhibits the concave curve with having a minimum point.

FIG. 6C shows an electrical power consumption property shown in the two-dimension profile on the iso-capacity plane Q2 of FIG. 6A. In a high capacity, the compressor consumes much electric power and the electrical power consumption increases more quickly as illustrated in FIG. 6C. The fan rotation decreases with a similar extent, but the discharge pressure increases more quickly, so it happens. Correspondingly, the outdoor fan 113 decreases its rotation rate to maintain the capacity Q2=constant and thus, the minimum point on the function Tw(rot) shifts to higher rotation rate of the outdoor fan 113. In one embodiment, the optimization process uses the fan rotation as the control variable, and thus, a target of the optimization is to seek the fan rotation rate that makes the function Tw(rot) minimum.

Figure 7A:
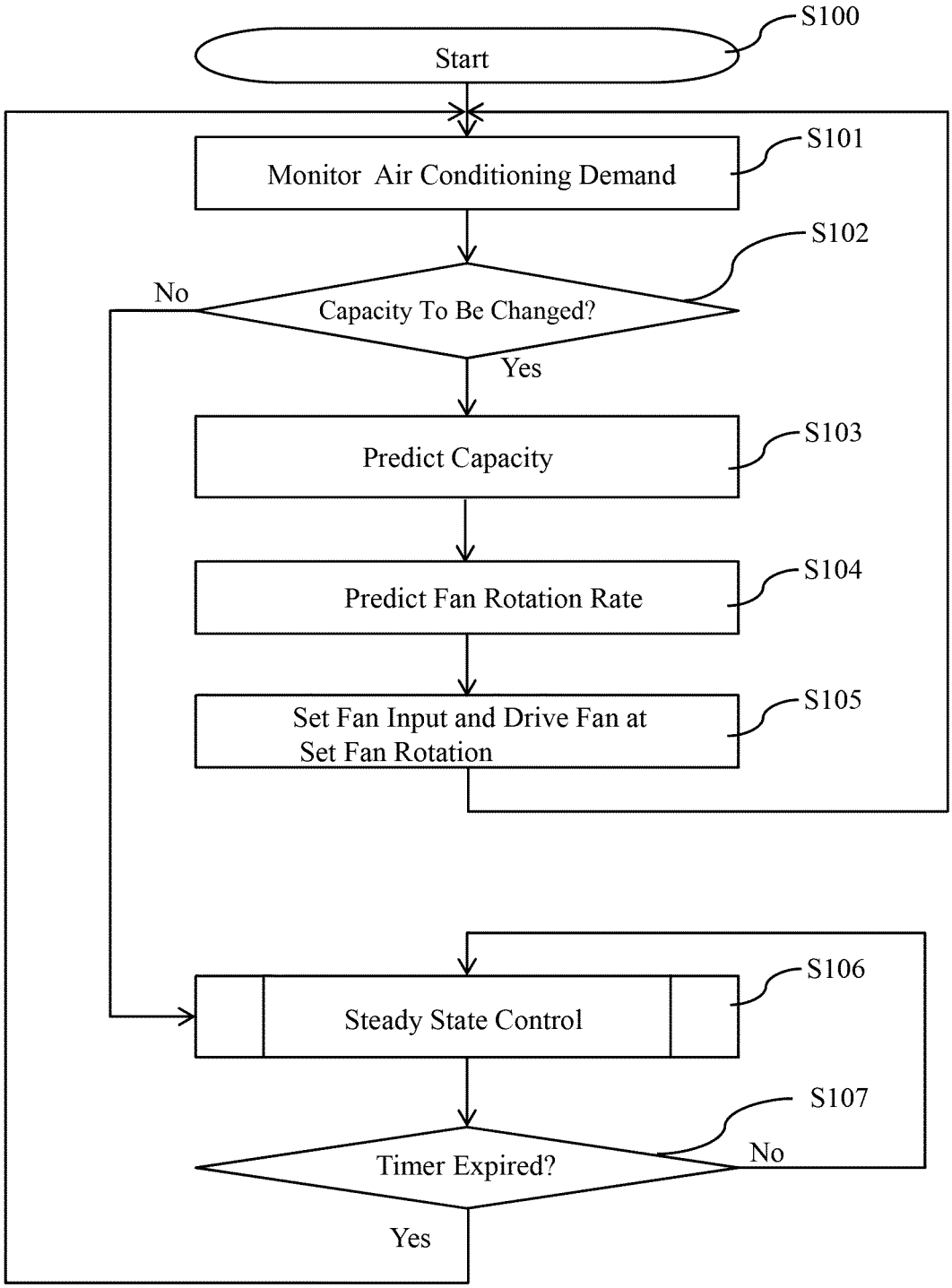
FIG. 7A is a flowchart of a process for controlling the air conditioning system of FIG. 1, according to some embodiments.
Figure 7B:
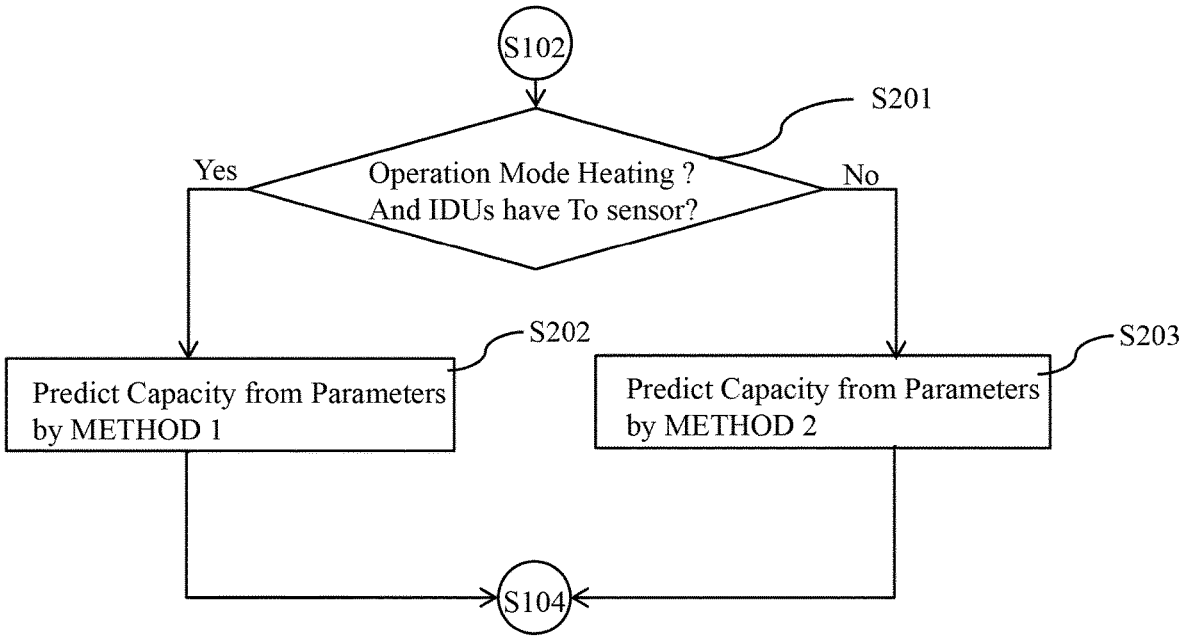
FIG. 7B is a flowchart of a process for predicting the capacity Q which can be performed as part of the process of FIG. 7A, according to some embodiments.
Figure 7C:
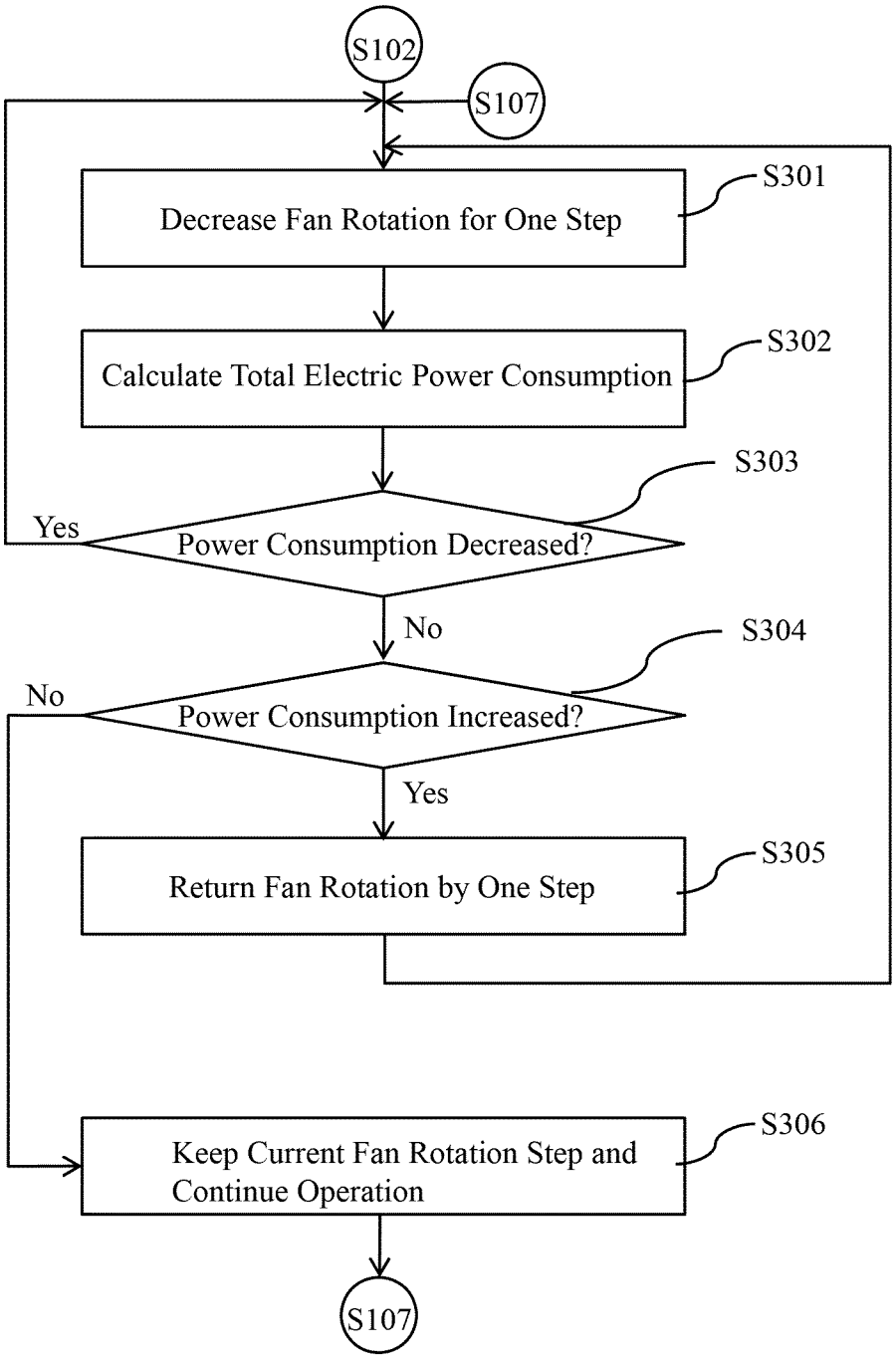
FIG. 7C is a flowchart of a process for steady state control of the air conditioning system of FIG. 1, according to some embodiments.

Referring now to FIGS. 7A-FIG. 7C, one embodiment of a control method to lower the electrical power consumption of the refrigeration cycle will be detailed. FIG. 7A shows a flowchart illustrating this process, according to one embodiment. The process is executed by the functional parts generated by the programs executed by the CPU 330. The process starts from Step S100 and in Step S101, the capacity monitor part 401 monitors signals sent from each of the IDUs 130-1, . . . , 130-*m* to predict capacity demands at near future. If the capacity demands are not expected to change in the near future based on the signals sent from the IDUs 130-1, . . . , 130-*mt* (Step S102; Yes), the process diverts to Step S106 and a steady state control part 406 starts steady state control for the air conditioning system. Step A106 may be performed here because the air conditioning capacity does not change largely and may be successfully controlled by seeking the minimum point of the function Tw(rot) by changing the rotation rate of the outdoor fan 114. For performing the determination in Step S102, a predetermined threshold may be set to the temperature signals so as to determine the capacity change. Such threshold may be set to each of the temperature signals or may be set to the total value of the input temperature values or output temperature values sent from each IDU. The threshold value may be determined depending on particular requirement and variable ranges of the power consumption of the outdoor fan 114 by the rotation rate.

The steady state control seeks in-plane minimum point on the iso-capacity plane at the current capacity such as Q1 and Q2 shown in FIG. 6A. Then, the process proceeds to Step S107 and waits expiration of a timer. The timer is used for addressing the time-lag in a physical system due to circulation of the refrigerant and like. In particular embodiment, the time duration may be about several minutes and so on. However, the time duration is not limited to particular values so far as the time duration can address the time-lag in a practical air conditioning system.

If the timer expires (S107: Yes), the process reverts to Step S101 to examine again the air conditioning demands. However, if the timer does not expire (S107: No), the process reverts to Step S106 to continue the steady state control. During the steady state control, the CPU 330 continuously seeks the minimum point on the iso-capacity plane. The detail of the steady state control will be described later.

If the determination in Step S102 returns an affirmative result (Step S102: Yes), since the capacity will change beyond the threshold, the process proceeds to Step S103 and predicts the capacity. Here, the prediction of capacity in Step S103 will be detailed and this process is executed by the capacity prediction part 404. If the capacity demands are expected to change from the sensor values from the IDUs 130-1, . . . , 130-*m*, the prediction of the capacity may be performed using a historical COP (coefficient of performance) values given by Eq. (1).

$$COP(n-1)=Q(n-1)/W_{Comp}(n-1)$$

$$Q(n)=COP(n-1)*W_{Comp}(n) \quad (1)$$

wherein n is a natural number and $W_{Comp}$ (n) is the current electrical power consumption and $W_{Comp}$(n−1) is the electrical power consumption just before. The electrical power consumption vales may be obtained using the current compressor input $W_{Comp}(n)$ and $W_{Comp}(n-1)$ using the data structure explained in FIG. 5B. Also, the vale $W_{Comp}(n-1)$ may be stored in an adequate storage such as a register memory of CPU 330 or the RAM 310 as the reference value.

Here referring to FIG. 7B, detail of the prediction of the capacity Q will be described. The prediction process starts when the control is passed from Step S102 and first determines whether or not the operation mode of the air conditioning system is a heating mode, for example, by looking-up an adequate data structure such as a flag recording the current operation mode of the system. If the operation mode is the heating mode (Step S201: Yes), the capacity is calculated by Method 1 using Eq. (2) so called as an air enthalpy method in Step S202.

$$Q=f(T_i, T_o, V, \rho, C_p) \tag{2}$$

wherein $T_i$ is an input temperature value detected by the sensor sent from the IDUs, $T_o$ is an output temperature value detected by the sensor also sent from the IDUs, V is an airflow amount ($m^3$/sec), ρ is a density of air, and $C_p$ is a specific heat (kJ/kg·K). In particular embodiment, Q may be predicted by using the following Eq. (3) in the air enthalpy method.

$$Q=C_p\times V\times\rho\times(T_i-T_o) \tag{3}$$

Alternatively, if the operation mode of the air conditioning system is a cooling mode rather than the heating mode (Step S201: No), the air enthalpy method is not adequate to predict the capacity due to loss of latent heat. The value of Q can be calculated by sensor values of the To sensor and implementation of the To sensor particularly realizes the estimation of the value of Q according to the embodiment. Thus, the capacity may be calculated from an Eq. (4) so called as a CC (Compressor Curve) method in Step S203. The CC method uses a circulation amounts of the refrigerant and a specific enthalpy of the refrigerant.

$$Q=f(\text{Compressor.Rotation}, V_{th}, \rho s, \Delta H) \tag{4}$$

wherein Compressor.Rotation is a rotation rate of the compressor 115, $V_{th}$ is a stroke volume, ρ is a density of the refrigerant, and ΔH is a specific enthalpy derived from a Mollier diagram of the refrigerant and is given by $\Delta H=(H_1-H_3)$. Here, $H_1$ is the specific enthalpy calculated from detected values of sensors Ps 119-2 and Ts 119-3 and $H_3$ is the specific enthalpy calculated from detected values of sensors Pd 119-1 and $T_{liq}$ 119-4. In a particular embodiment, Q calculated by the CC method may be given as the following Eq. (5).

$$Q=V_{th}\times\text{Compressor.Rotation}\times\rho s\times\Delta H \tag{5}$$

In one embodiment, where a plurality of the IDUs is connected in the air conditioning system such as the VRF system, capacities of each IDU may be predicted individually and each of the predicted capacity may be summed to predict the total capacity of the system.

Alternatively, in another embodiment and depending on particular requirements, the actual electrical power consumption of the compressor 115 may be measured by a sensor and the measured electrical power consumption $RW_{Comp}$ values, which is the electrical power consumption actually detected, may be stored historically in the storage in time-series to calculate the capacity Q in the CC method. When the prediction of Step S202 or Step S203 is completed, the process proceeds to Step S104 and returns the process to Step S104 in FIG. 7A.

Now, again referring to FIG. 7A, in Step S104, the targeted fan rotation rate is calculated by the fan rotation prediction part 405. The targeted fan rotation rate may be calculated using historical values by using the following Eq. (6) in cooling mode and Eq. (7) in heating mode.

$$\text{Fan. Rotation}(n)=\frac{[Q(n)+W_{Comp}(n)]}{[Q(n-1)+W_{Comp}(n-1)]}\times\text{Fan. Rotation}(n-1) \tag{6}$$

$$\text{Fan. Rotation}(n)=\frac{[Q(n)-W_{Comp}(n)]}{[Q(n-1)-W_{Comp}(n-1)]}\times\text{Fan. Rotation}(n-1) \tag{7}$$

wherein Fan.Rotation (n) is the targeted fan rotation rate and Fan.Rotation (n−1) is the rotation rate of the outdoor fan 114 just before.

From the computed Fan.Rotation (n), the targeted fan input $I_{Fan_target}$ can be determined in Step S105 using the data structure shown in FIG. 5A by the fan driving part 403. For example, when Fan.Rotation (n) has been calculated once, the fan driving part 403 selects the operation step $I_{Fan}$ providing the fan rotation rate nearest to the targeted fan input $I_{Fan_target}$. Then, the fan driving part 403 sends the determined $I_{Fan_target}$ to the inverter 117 to control the fan motor 114 according to the targeted rotation rate.

With referring to FIG. 7C, the process of the steady state control will be explained. The term "steady state control" means the control when the capacity of the air conditioning system is not expected to change or is expected to be almost constant. In other words, a generated capacity is regarded as almost constant and the Tw(rot) is optimized merely by the control in the fan input $I_{Fan}$ using an ESC (Extremum Seeking Control) method.

The process starts when the control is passed from Step S102 or Step S107, and in Step S301, the steady state control part 406 decreases the fan rotation rate by one step. In Step S302, the steady state control part 406 calculates the electrical power consumption Tw (rot) and then, determines in Step S303 whether or not the electrical power consumption decreases with comparing to the electrical power consumption just before decrement of the operation step.

If the electrical power consumption after the decrement of the operation step of the fan motor 114 decreases (S303: Yes), the process reverts to Step S301 and decreases again the fan rotation rate further by one step. These steps will be repeated until the determination in Step S303 returns a negative result (Step S303: No) because this determination means the total value of the electrical power consumption was increased beyond a threshold or kept by decrement of the fan operation rate. If the determination in Step S303 returns the negative result (S303: No), the process proceeds to Step S304 and determines whether or not the electrical power consumption has increased due to the decrement of the operation step. If the electrical power consumption has been increased (Step S304: Yes), the process returns the fan rotation rate to the value just before the increment of the operation step in Step S305. Thereafter, the process reverts to Step S301 to repeat the steps from Step S301 to Step S305.

If the determination in Step S304 returns a negative result (S304: No), since the electric power consumption is kept unchanged within the predetermined threshold at the current operation step of the fan motor 114, then the current operation step for the fan motor 114 is kept in Step S306. Thereafter the process passes the control to Step S107 to continue the fan operation at the current operation step until the timer will expire.

Figure 8:
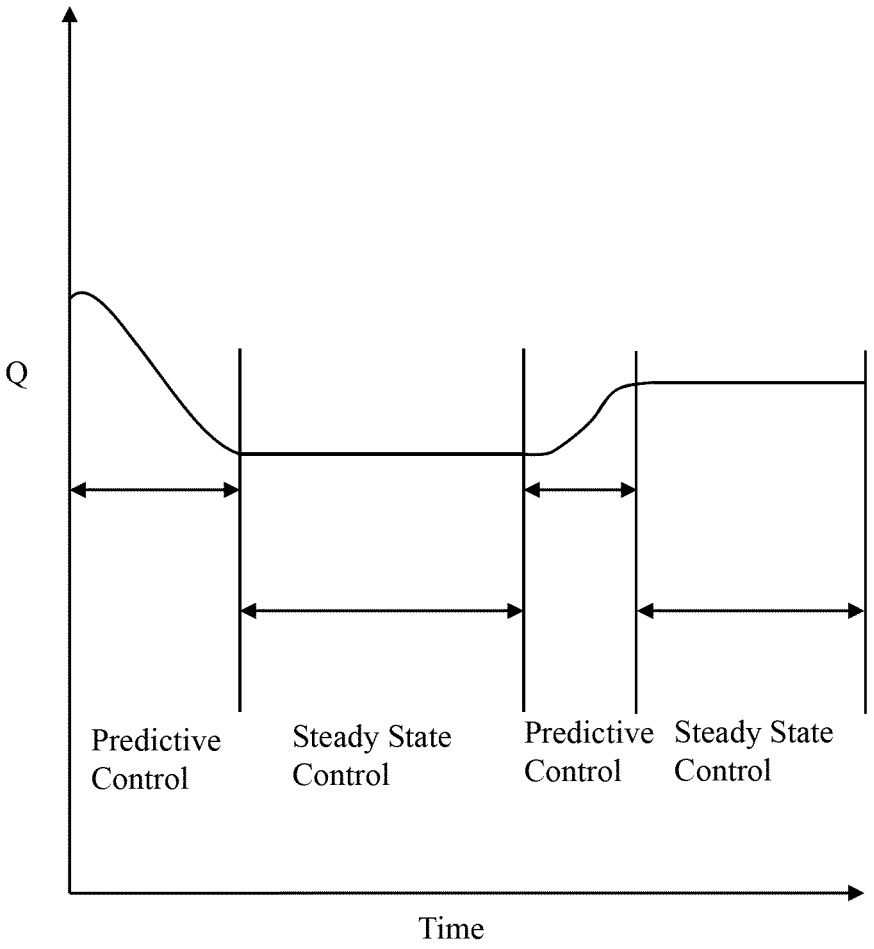
FIG. 8 is a graph illustrating an overall control cycle of the air conditioning system of FIG. 1, according to some embodiments.

FIG. 8 schematically shows an overall control cycle of the embodiment according to the present invention. During the operation period under the relatively large capacity change, the air conditioning system performs the predictive control that predicts the capacity from the detected values by the sensors according to the first strategy. On the other hand, during the operation period without large capacity change, the air conditioning system performs the steady state control using the ESC method according to the second strategy.

The program in the described embodiment may be coded by any programming languages such as an assembler language, a C language, a C++ language or other programming languages adapted to network communication including PYTHON, a browser software and so on. In another particular embodiment, the air conditioning system may be implemented as a network system connected through a wireless communication between the outdoor unit 110 and the IDUs 130-1, . . . , 130-3 as well as the server rather than hard-wired communication lines.

In further another embodiment, the controller 116 may be implemented as a separate computer so called as a server for managing a large scaled refrigeration cycle such as, for example, an air conditioning system in a skyscraper or an intelligent city where air conditioning demands of houses or buildings and so on is served by the refrigeration cycle of the present invention. In this embodiment, the server may be networked to the indoor units and the outdoor unit through the wireless transmission network and the server controls the outdoor unit so as to control the air conditioning capacity to serve the air conditioning demands.

Thus, the compressor 115 and the outdoor fan 113 may be controlled automatically in their optimum electrical power consumption conditions in two independent control strategies based on the prediction for air conditioning demands such that the efficient and economical operation of the system may be achieved. Even though the capacity changes largely, the optimum condition may be sought and the outdoor fan may also be adjusted optimally, thereby the electrical power consumption under the operation in a partial load may be suppressed and annual electrical power consumption may also be suppressed.

Configuration of Exemplary Embodiments

As set forth so far, preferred embodiments of the present invention have been described, the present invention should not be limited to particular relating embodiments, and various modifications and alternations may be made by those having ordinary skill in the art without departing scope of the present invention and the true scope should be determined only by appended claims.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A refrigeration cycle for an air conditioning system including an outdoor unit and an indoor unit, the refrigeration cycle comprising:

a controller controlling a compressor and an outdoor fan of the air conditioning system so as to minimize a total electric power consumption of the air conditioning system by a capacity prediction part of the controller predicting a capacity demand in an air conditioning space; and an inverter controlling the outdoor fan in a rotation rate predicted from the capacity demand in the air conditioning space, the capacity demand in the air conditioning space depending on an operation mode and temperature sensor values sent from the indoor unit;

wherein the controller predicts the capacity demand in the air conditioning space and controls the rotation rate of the outdoor fan based on a prediction of the capacity demand in the air conditioning space;

wherein the rotation rate of the outdoor fan is determined using a ratio comprising historical values of the capacity demand predicted and the total electric power consumption.

2. The refrigeration cycle of claim 1, wherein the controller predicts the capacity demand using an air enthalpy method in a heating mode or using a compressor curve method in a cooling mode when the capacity demand is predicted to change.

3. The refrigeration cycle of claim 1, wherein the controller determines the rotation rate of the outdoor fan so as to minimize the total electric power consumption of the compressor and the outdoor fan when the capacity demand is predicted to remain substantially constant.

4. The refrigeration cycle of claim 1, wherein the controller predicts the capacity demand using historical changes in electrical power consumption of the compressor and a historical capacity demand.

5. An air conditioning system including an outdoor unit and an indoor unit, the air conditioning system comprising:

a controller controlling a compressor and an outdoor fan of the air conditioning system so as to minimize a total electric power consumption of the air conditioning system by a capacity prediction part of the controller predicting a capacity demand in an air conditioning space; and an inverter controlling the outdoor fan in a rotation rate predicted from the capacity demand in the air conditioning space, the capacity demand in the air conditioning space depending on an operation mode and temperature sensor values sent from the indoor unit;

wherein the controller predicts the capacity demand in the air conditioning space and controls the rotation rate of the outdoor fan based on a prediction of the capacity demand in the air conditioning space;

wherein the rotation rate of the outdoor fan is determined using a ratio comprising historical values of the capacity demand predicted and the total electric power consumption.

6. The air conditioning system of claim 5, wherein the controller predicts the capacity demand using an air enthalpy method in a heating mode or using a compressor curve method in a cooling mode when the capacity demand is predicted to change.

7. The air conditioning system of claim 5, wherein the controller determines the rotation rate of the outdoor fan so as to minimize the total electric power consumption of the compressor and the outdoor fan when the capacity demand is predicted to remain substantially constant.

8. The air conditioning system of claim 5, wherein the controller predicts the capacity demand using historical changes in electrical power consumption of the compressor and a historical capacity demand.

9. The air conditioning system of claim 5, comprising a plurality of indoor units controlled by the controller implemented in a shared outdoor unit.

10. A method for controlling a refrigeration cycle including an outdoor unit and an indoor unit, the method comprising:

controlling a compressor and an outdoor fan of so as to minimize a total electric power consumption of an air conditioning system by a capacity prediction part predicting a capacity demand in an air conditioning space; and controlling the outdoor fan in a rotation rate predicted from the capacity demand in the air conditioning space, the capacity demand in the air conditioning space depending on an operation mode and temperature sensor values sent from the indoor unit;

wherein the rotation rate of the outdoor fan is determined using a ratio comprising historical values of the capacity demand predicted and the total electric power consumption.

11. The method for controlling a refrigeration cycle of claim 10, wherein the capacity demand is predicted using an air enthalpy method in a heating mode or using a compressor curve method in a cooling mode when the capacity demand is predicted to change.

12. The method for controlling a refrigeration cycle of claim 10, wherein the rotation rate of the outdoor fan is determined so as to minimize the total electric power consumption of the compressor and the outdoor fan when the capacity demand is predicted to remain substantially constant.

13. The method for controlling a refrigeration cycle of claim 10, wherein the capacity demand is predicted using historical changes in electrical power consumption of the compressor and a historical capacity demand.

14. The method for controlling a refrigeration cycle of claim 10, wherein the air conditioning system comprises a plurality of indoor units controlled by a shared outdoor unit.

* * * * *